US008313096B2

(12) United States Patent
Yamagishi et al.

(10) Patent No.: US 8,313,096 B2
(45) Date of Patent: Nov. 20, 2012

(54) IMAGE READING APPARATUS, MULTIFEED DETERMINING METHOD, AND MULTIFEED DETERMINING PROGRAM

(75) Inventors: Hiroshi Yamagishi, Ishikawa (JP); Shinji Suzuki, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 13/043,890

(22) Filed: Mar. 9, 2011

(65) Prior Publication Data

US 2011/0278786 A1 Nov. 17, 2011

(30) Foreign Application Priority Data

May 14, 2010 (JP) ..... 2010-112446

(51) Int. Cl.
*B65H 5/00* (2006.01)

(52) U.S. Cl. ..... 271/10.03; 271/262; 271/263

(58) Field of Classification Search ..... 271/10.03, 271/262, 263
See application file for complete search history.

(56) References Cited

U.S. PATENT DOCUMENTS

| | | | | |
|---|---|---|---|---|
| 2003/0006550 | A1* | 1/2003 | Chujo et al. | 271/262 |
| 2006/0145412 | A1 | 7/2006 | Tagawa et al. | |
| 2006/0289424 | A1* | 12/2006 | Ishii | 219/243 |
| 2008/0224390 | A1* | 9/2008 | Ma et al. | 271/258.01 |

FOREIGN PATENT DOCUMENTS

| | | |
|---|---|---|
| JP | 05-040030 | 2/1993 |
| JP | 2004-269241 | 9/2004 |

* cited by examiner

*Primary Examiner* — Jeremy R Severson
(74) *Attorney, Agent, or Firm* — McDermott Will & Emery LLP

(57) ABSTRACT

An image reading apparatus includes an ultrasonic sensor and a control unit. The control unit monitors each of multi-valued output values of the ultrasonic sensor in absence of a paper, in absence of an overlap, and in presence of an overlap, sets an optimal threshold of multifeed determination for a thickness of a paper based on the monitored values in the absence of a paper and in the absence of an overlap, and performs the multifeed determination using the set threshold and the value in the presence of an overlap.

3 Claims, 11 Drawing Sheets

CARDBOARD (180K)

DELIVERY SLIP WITHOUT WRINKLE, NO SEAL

THIN PAPER (TYPING PAPER 22K), NO SEAL

DELIVERY SLIP WITHOUT WRINKLE, SEAL ATTACHED THERETO

DELIVERY SLIP WITHOUT WRINKLE, TWO-SHEET OVERLAP, NO SEAL

THIN PAPER (TYPING PAPER 22K), TWO-SHEET OVERLAP, NO SEAL

IMAGE READING APPARATUS, MULTIFEED DETERMINING METHOD, AND MULTIFEED DETERMINING PROGRAM

CROSS-REFERENCE TO RELATED APPLICATION

This application is based upon and claims the benefit of priority from Japanese Patent Application No. 2010-112446, filed on May 14, 2010, the entire contents of which are incorporated herein by reference.

BACKGROUND OF THE INVENTION

1. Field of the Invention

The present invention relates to an image reading apparatus (e.g., a scanner, a copier, and a facsimile) that includes a multifeed (MF) detecting function using an ultrasonic (US) sensor, and a multifeed determining method and a multifeed determining program.

2. Description of the Related Art

In a technology described in Japanese Patent Application Laid-open No. H05-40030, as a threshold (MF determination slice) of MF determination performed in an MF detecting function using an US sensor, a fixed value is set by taking into consideration cardboards with which an output of the US sensor becomes low.

However, according to the conventional technology, there is a problem that because the fixed value is set as the MF determination slice by taking into consideration cardboards with which an output of the US sensor becomes low, the MF determination slice is low in a case of thin paper and MF detection accuracy is thereby insufficient.

SUMMARY OF THE INVENTION

It is an object of the present invention to at least partially solve the problems in the conventional technology.

An image reading apparatus according to one aspect of the present invention includes an ultrasonic sensor and a control unit. The control unit monitors each of multi-valued output values of the ultrasonic sensor in absence of a paper, in absence of an overlap, and in presence of an overlap, sets an optimal threshold of multifeed determination for a thickness of a paper based on the monitored values in the absence of a paper and in the absence of an overlap, and performs the multifeed determination using the set threshold and the value in the presence of an overlap.

An image reading apparatus according to one aspect of the present invention includes an ultrasonic sensor and a control unit. The control unit includes (i) a receiving unit that receives an output of the ultrasonic sensor, (ii) a holding unit that holds the output received by the receiving unit as any one of an output when there is no paper, an output when there is no overlap of papers, and an output when there is an overlap of papers, (iii) a changing unit that changes a previously set threshold of multifeed determination to an optimal value for a thickness of the paper based on the output held as the output when there is no paper and the output held as the output when there is no overlap of papers by the holding unit, and (iv) a determining unit, when there is an output held as the output when there is an overlap of papers by the holding unit, compares the output and a threshold after it is changed by the changing unit, to perform multifeed determination.

A multifeed determining method according to one aspect of the present invention is implemented by a control unit of an image reading apparatus that includes an ultrasonic sensor and the control unit. The multifeed determining method includes (i) a receiving step of receiving an output of the ultrasonic sensor, (ii) a holding step of holding the output received at the receiving step as any one of an output when there is no paper, an output when there is no overlap of papers, and an output when there is an overlap of papers, (iii) a changing step of changing a previously set threshold of multifeed determination to an optimal value for a thickness of the paper based on the output held as the output when there is no paper and the output held as the output when there is no overlap of papers at the holding step, and (iv) a determining step of, when there is an output held as the output when there is an overlap of papers at the holding step, comparing the output and a threshold after it is changed at the changing step, to perform multifeed determination.

A multifeed determining program product according to one aspect of the present invention makes a control unit of an image reading apparatus that includes an ultrasonic sensor and the control unit implement a multifeed determining method. The multifeed determining method includes (i) a receiving step of receiving an output of the ultrasonic sensor, (ii) a holding step of holding the output received at the receiving step as any one of an output when there is no paper, an output when there is no overlap of papers, and an output when there is an overlap of papers, (iii) a changing step of changing a previously set threshold of multifeed determination to an optimal value for a thickness of the paper based on the output held as the output when there is no paper and the output held as the output when there is no overlap of papers at the holding step, and (iv) a determining step of, when there is an output held as the output when there is an overlap of papers at the holding step, comparing the output and a threshold after it is changed at the changing step, to perform multifeed determination.

A recording medium according to one aspect of the present invention includes the multifeed determining program product described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of an image reading apparatus, a multifeed determining method, and a multifeed determining program according to the present invention will be explained in detail below with reference to the accompanying drawings. It should be noted that the present invention is not limited by the embodiments.

1. Overview of Present Embodiment

Figure 3A:
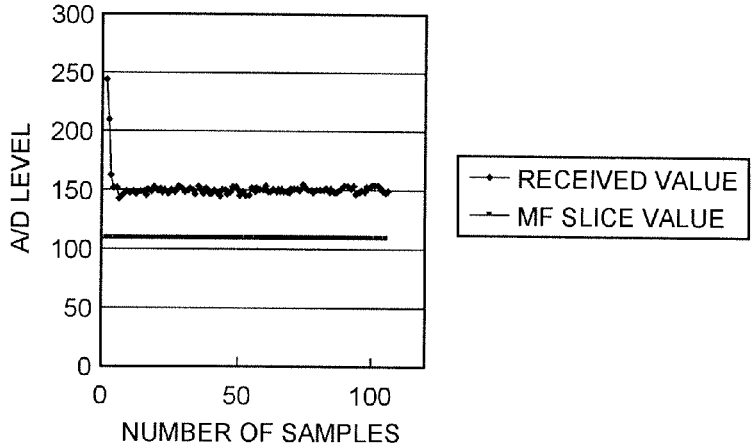
FIGS. 3A to 3C are diagrams representing one examples of a relationship between an US-sensor output value and an MF slice value when there is no overlap.
Figure 3B:
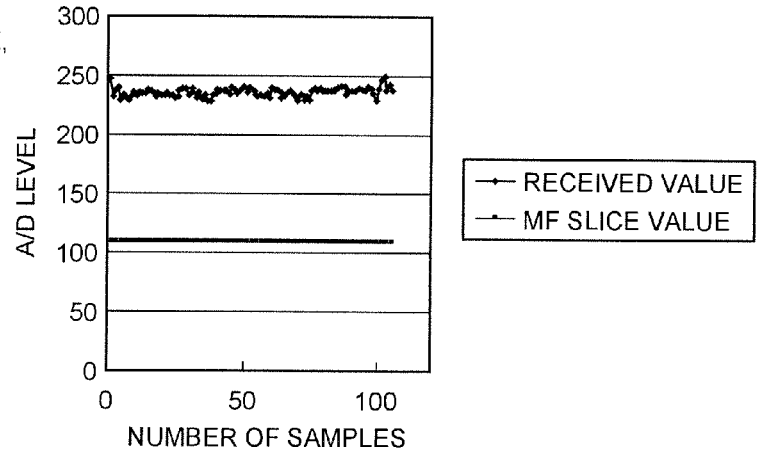
Figure 3C:
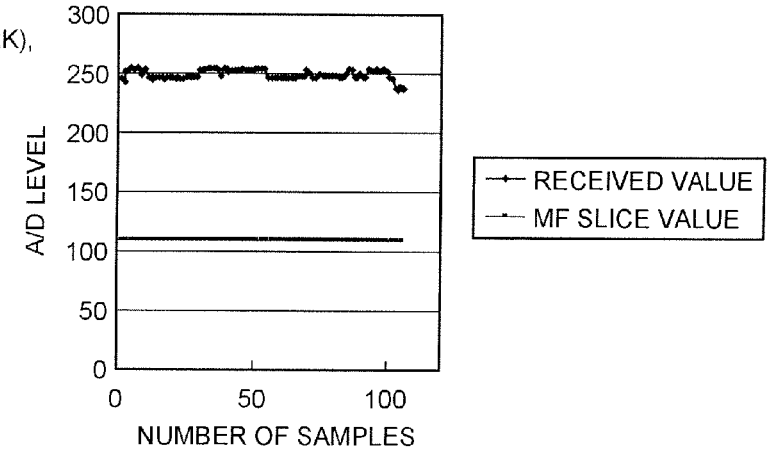
Figure 4A:
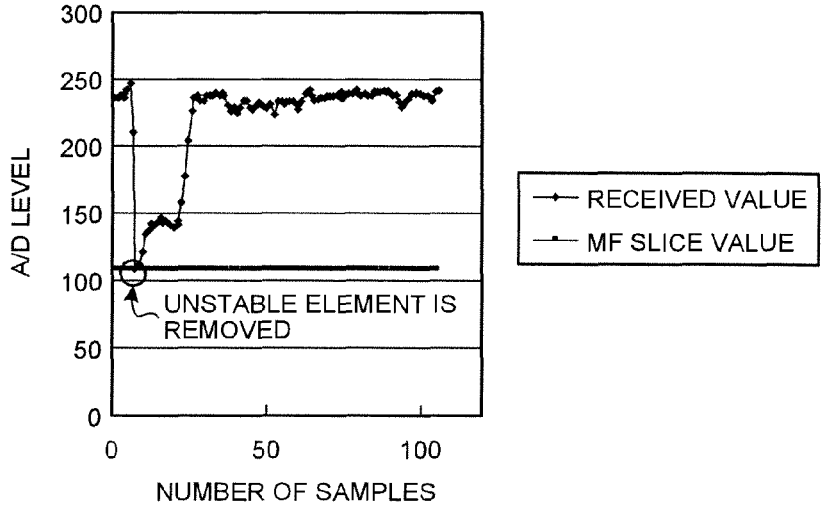
FIGS. 4A to 4C are diagrams representing one examples of a relationship between an US-sensor output value and an MF slice value when there is an overlap.
Figure 4B:
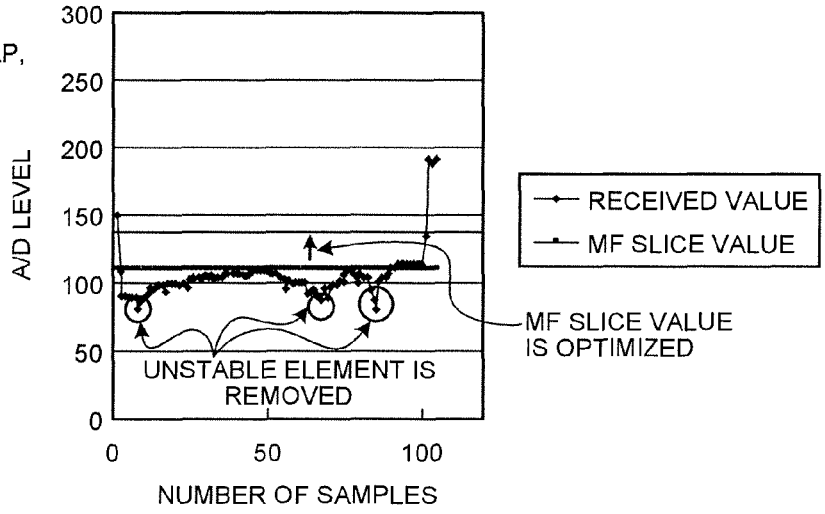
Figure 4C:
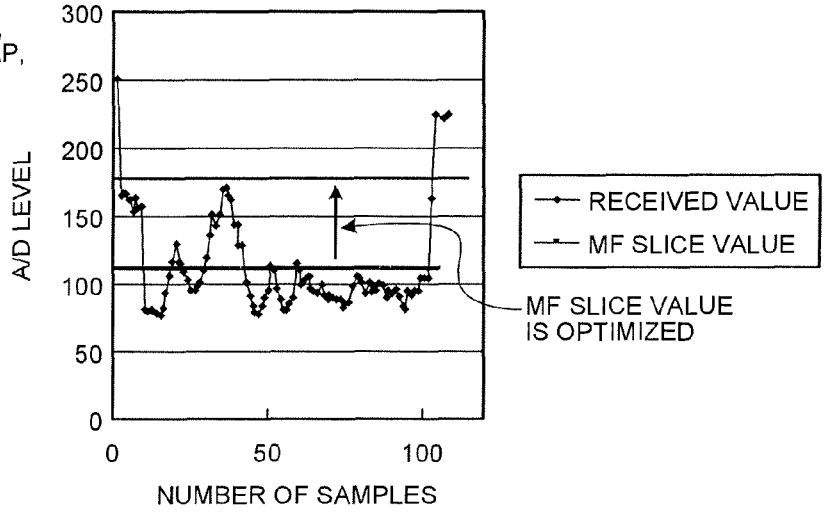

Here, the overview of the present embodiment will be explained with reference to FIG. 1A through FIG. 4C. FIGS. 1A and 1B and FIGS. 2A and 2B are diagrams representing the overview of the present embodiment. FIGS. 3A to 3C are diagrams representing one examples of a relationship between an US-sensor output value and an MF slice value when there is no overlap. FIGS. 4A to 4C are diagrams representing one examples of a relationship between an US-sensor output value and an MF slice value when there is an overlap.

Generally, the image reading apparatus (e.g., a scanner, a copier, and a facsimile) that includes a multifeed (MF) detecting mechanism using an ultrasonic (US) sensor compares an output (received value (A/D level)) of the US sensor and a preset threshold (MF determination slice value), and determines whether MF occurs.

Figure 1A:
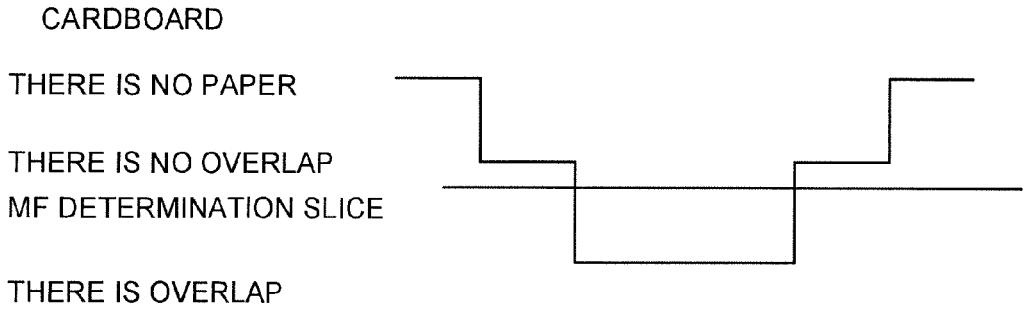
FIGS. 1A and 1B are diagrams representing an overview of a present embodiment.

However, as shown in FIG. 1A, the preset MF determination slice value is a fixed value by taking into consideration a cardboard with which an output of the US sensor becomes low. Therefore, in a case of a thin paper, the MF determination slice value is low, and the MF detection accuracy is thereby insufficient.

Figure 1B:
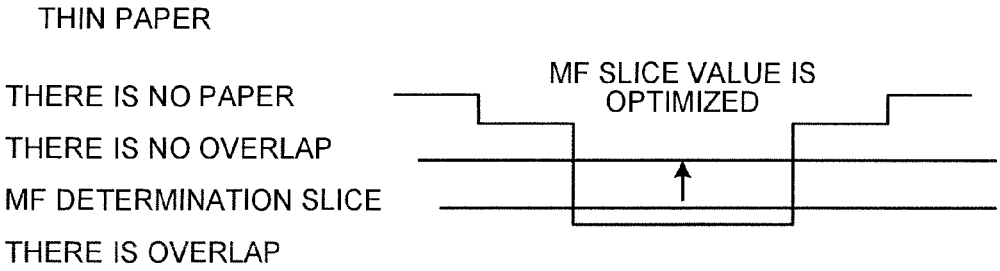

In the present embodiment, therefore, as shown in FIG. 1B, each of multi-valued outputs (transmittance) of the US sensor "in the absence of a paper", "in the absence of an overlap", and "in the presence of an overlap" is monitored, an optimal MF determination slice value for the thickness of a fed paper is set based on the monitored values "in the absence of a paper" and "in the absence of an overlap", and MF determination is performed using the set MF determination slice value and the value "in the presence of an overlap". As a result, the MF detection accuracy for papers of all thicknesses can be improved.

As for the thin paper in particular, a temporary variation can be seen in outputs of the US sensor in the conventional technology. However, because a multi-valued output value of the US sensor is used as it is, an overlap portion cannot sometimes be determined precisely.

Figure 2A:
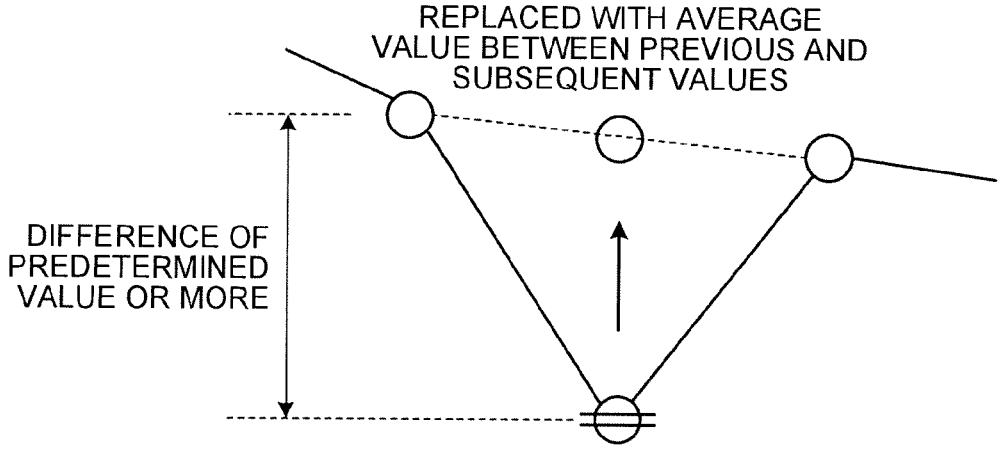
FIGS. 2A and 2B are diagrams representing the overview of the present embodiment.
Figure 2B:
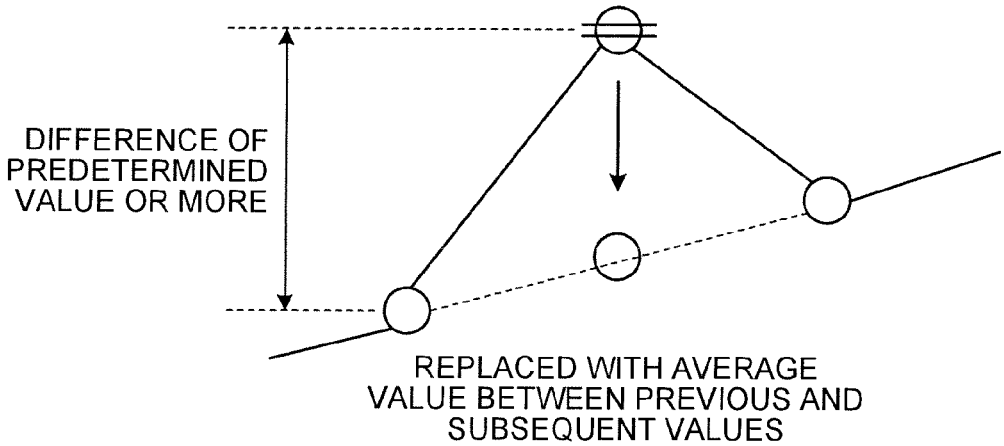

In the present embodiment, therefore, as shown in FIGS. 2A and 2B, if a monitored multi-valued output value of the US sensor largely varies as compared with values before and after the monitoring, the monitored value is replaced with an average value of the values before and after the monitoring. Specifically, when a difference between a monitored current output value and an output value right before the monitoring is equal to or more than a predetermined value and if an output value right after the monitoring is closer (returned) to the output value right before the monitoring than the current output value, the current output value is replaced with an average value of the previous output value and the subsequent output value. Thus, the temporary variation of the US-sensor output is ignored (particularly, an unstable element (noise component) of US-sensor outputs before and after the MF determination slice is removed), so that an overlap portion can be accurately and stably detected.

As mentioned above, according to the present embodiment, in the case where there is no overlap as shown in FIGS. 3A to 3C, MF determination is performed using an existing value by taking the cardboard into consideration without the change of the MF determination slice value. Therefore, cases of a delivery slip and a thin paper (e.g., typing paper 22K), to say nothing of the case of the cardboard (e.g., typing paper 180K), are also determined as "No MF".

According to the present embodiment, in the case where there is an overlap as shown in FIG. 4A, the MF determination slice value is not changed but the MF determination is performed by removing an unstable element near the MF determination slice value. Therefore, the present case where, so far, it has been determined as "Occurrence of MF" is determined as "No MF" as expected. In the case where there is an overlap as shown in FIG. 4B, the MF determination slice value is optimized by taking into consideration the thickness of the delivery slip and the MF determination is performed by eliminating influence on discrimination of attachment due to temporary variation. Therefore, this case is determined as "Occurrence of MF" as expected. Moreover, according to the present embodiment, in the case where there is an overlap as shown in FIG. 4C, the MF determination slice value is optimized by taking into consideration the thickness of a thin paper (e.g., typing paper 22K) and the MF determination is performed. Therefore, this case is determined as "Occurrence of MF" as expected.

2. Configuration of Present Embodiment

Figure 5:
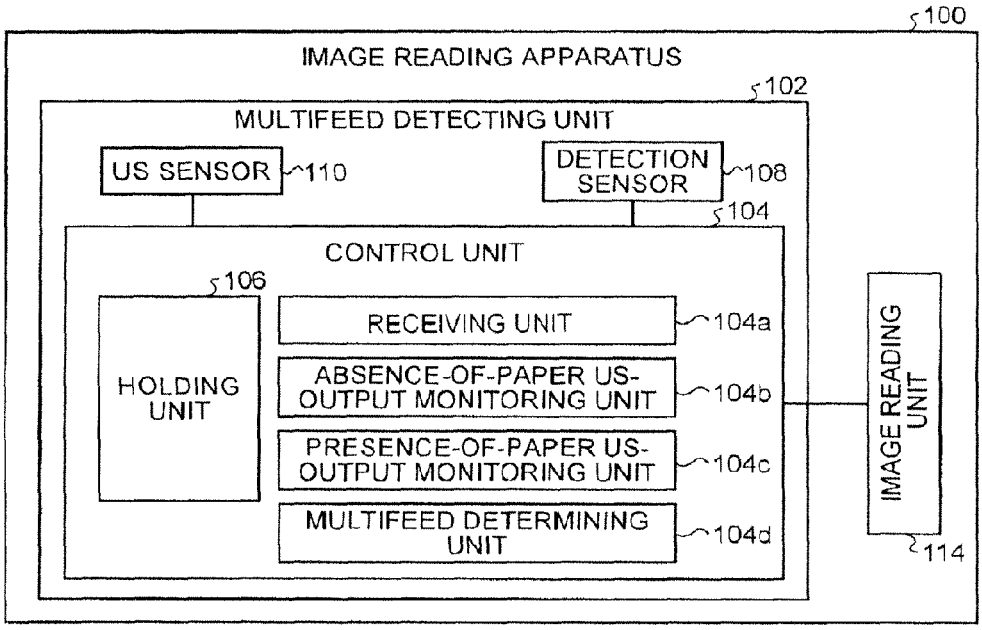
FIG. 5 is a diagram representing one example of a configuration of an image reading apparatus according to the present embodiment.

Here, the configuration of an image reading apparatus 100 according to the present embodiment will be explained with reference to FIG. 5 to FIG. 7.

2-1. Overview of Configuration

First, the overview of the configuration of the image reading apparatus 100 according to the present embodiment will be explained with reference to FIG. 5. FIG. 5 is a diagram representing one example of the configuration of the image reading apparatus according to the present embodiment.

The image reading apparatus 100 includes a multifeed detecting unit (mechanism) 102 and an image reading unit (mechanism) 114 in a functionally conceptual manner, and these units are communicably connected to each other through an arbitrary communication path.

The multifeed detecting unit 102 is a mechanism for detecting a MF of a fed paper, and includes at least a control unit 104 such as CPU (Central Processing Unit) for controlling the image reading apparatus 100 (particularly, multifeed detecting unit 102), a detection sensor 108 for detecting a leading edge of the fed paper, and a US sensor 110 for detecting an overlap of papers using ultrasonic waves in a functionally conceptual manner as shown in the figure. The detection sensor 108 is disposed along a feed path of the paper and is disposed on the upstream side of a position where the US sensor 110 is disposed. A specific example of the configuration of the multifeed detecting unit 102 will be explained in detail later in "2-2. Specific Example of Configuration". The image reading unit 114 is a mechanism for reading a fed paper and generating an image of the paper.

The control unit 104 includes an internal memory for storing therein a control program such as OS (Operating System) and programs defining various processing procedures or the like and also storing therein required data, and performs information processing for executing various processes based on the programs. The control unit 104 includes a receiving unit 104*a* corresponding to a receiving unit of the present invention, an absence-of-paper US-output monitoring unit 104*b* (absence-of-paper monitoring unit 104*b*) included in a holding unit of the present invention, a presence-of-paper US-output monitoring unit 104*c* (presence-of-paper monitoring unit 104*c*) included in the holding unit of the present invention, a multifeed determining unit 104*d* corresponding to a determining unit of the present invention, and a holding unit 106 included in the holding unit of the present invention, in a functionally conceptual manner.

The holding unit 106 is used to hold calculation and execution statuses, and includes the following registers and flags. The holding unit 106 holds therein US-sensor multi-valued output values received by the receiving unit 104*a* explained later.

"Monitor value register of US-sensor multi-valued outputs in the absence of a paper (absence-of-paper monitor value register)" for storing therein an average value of US-sensor multi-valued outputs monitored when there is no paper.

"Monitor value register of US-sensor multi-valued outputs in the absence of an overlap (absence-of-overlap monitor value register)" for storing therein an average value of US-sensor multi-valued outputs monitored when there is no overlap of papers.

"Monitor value fluctuation-range register of US-sensor multi-valued outputs in the absence of an overlap (absence-of-overlap fluctuation-range register)" for storing therein a fluctuation range (a difference between a maximum value and a minimum value) of US-sensor multi-valued outputs monitored when there is no overlap of papers.

"Monitor value register of US-sensor multi-valued outputs in the presence of an overlap (presence-of-overlap monitor value register)" for storing therein an average value of US-sensor multi-valued outputs monitored when there is an overlap of papers.

"Flag indicating arrival of leading edge of paper at US sensor (leading-edge arrival flag)" for managing an arrival state of the leading edge of the paper at the US sensor 110 has already arrived or has not yet arrived).

"Flag indicating that MF determination slice value can be changed (slice change flag)" for managing a changeable state of the MF determination slice value (it can be changed or cannot be changed).

The receiving unit 104*a* receives a current value of a US-sensor output from the US sensor 110.

When the US-sensor output set as a replacement candidate (remark value) is held in the holding unit 106 and the received current value of the US-sensor output is closer (returned) to the value of the US-sensor output right before the replacement candidate than the value of the US-sensor output as the replacement candidate, the receiving unit 104*a* regards the value of the US-sensor output as the replacement candidate held in the holding unit 106 as a noise component and replaces it with an average value between the current value and the value of the US-sensor output right before the replacement candidate. When a difference between the received current value of the US-sensor output and the value of the US-sensor output which is the previous value of the current value and is held in the holding unit 106 is equal to or more than a predetermined value (e.g., 10% of the previous value), then the receiving unit 104*a* sets the current value as the replacement candidate.

The absence-of-paper monitoring unit 104*b*, when the leading edge of the paper has not reached the US sensor 110, holds the current value of the output received by the receiving unit 104*a* as "absence-of-paper monitor value" (which is, specifically, held in the holding unit 106 based on time series). When the leading edge of the paper has reached the US sensor 110, the absence-of-paper monitoring unit 104*b* calculates an average value of the US-sensor outputs as "absence-of-paper monitor values" held in the holding unit 106, sets the calculated average value in the absence-of-paper monitor value register, and sets the leading-edge arrival flag.

When the average value set in the absence-of-paper monitor value register is equal to or more than the predetermined value (e.g., 95% of a theoretical maximum value), the absence-of-paper monitoring unit 104*b* recognizes that there is no abnormality in the US-sensor outputs, and sets the slice change flag in order to enable to change the MF determination slice value.

The presence-of-paper monitoring unit 104*c*, when the current value of the output received by the receiving unit 104*a* is equal to or less than the MF determination slice value, holds the current value as "presence-of-overlap monitor value" (which is, specifically, held in the holding unit 106 based on time series). When the fluctuation range held in the absence-of-overlap fluctuation-range register is larger than the predetermined value, the presence-of-paper monitoring unit 104*c* holds the current value of the output received by the receiving unit 104*a* as "presence-of-overlap monitor value".

When the average value has not been set in the absence-of-overlap monitor value register, the presence-of-paper monitoring unit 104*c* holds the current value of the output received by the receiving unit 104*a* as "absence-of-overlap monitor value" (which is, specifically, held in the holding unit 106 based on time series). The presence-of-paper monitoring unit 104*c* sets the fluctuation range (a difference between the maximum value and the minimum value) of the US-sensor outputs as "absence-of-overlap monitor values" held in the holding unit 106, in the absence-of-overlap fluctuation-range register.

When the number of US-sensor outputs as "absence-of-overlap monitor values" held in the holding unit 106 is equal to or more than a predetermined number (e.g., 50), the presence-of-paper monitoring unit 104*c* calculates an average value of the US-sensor outputs as "absence-of-overlap monitor values" held in the holding unit 106, and sets the calculated average value in the absence-of-overlap monitor value register. When the MF determination slice value can be changed, the presence-of-paper monitoring unit 104*c* sets (changes) the preset MF determination slice value to an optimal value for the thickness of the paper based on the average value set in the absence-of-overlap monitor value register.

The multifeed determining unit 104*d*, when the US-sensor outputs as "presence-of-overlap monitor values" are not held in the holding unit 106, determines this case as "No MF", and causes the feeding of the paper not to stop and the image reading unit 114 to continue the reading. When the US-sensor outputs as "presence-of-overlap monitor values" are held in the holding unit 106, the multifeed determining unit 104*d* calculates an average value of the US-sensor outputs as "presence-of-overlap monitor values" held in the holding unit 106, and sets the calculated average value in the presence-of-overlap monitor value register.

The multifeed determining unit 104*d* compares the average value set in the presence-of-overlap monitor value register and the MF determination slice value, determines, when the set average value is larger than the MF determination slice value, this case as "No MF", and causes the feeding of the paper not to stop and the image reading unit 114 to continue the reading. When the set average value is equal to or less than the MF determination slice value, the multifeed determining unit 104*d* determines this case as "Occurrence of MF" and performs handling of occurrence of MF such that the feeding of the paper is caused to stop and the like.

2-2. Specific Example of Configuration

Next, a specific example of the configuration of the image reading apparatus 100 configured in the above manner will be explained in detail with reference to FIG. 6 and FIG. 7. A specific configuration of the image reading apparatus which is a scanner is explained herein, however, the image reading apparatus is not limited to the scanner, and thus can be applied to a copier, a facsimile, or the like.

Figure 6:
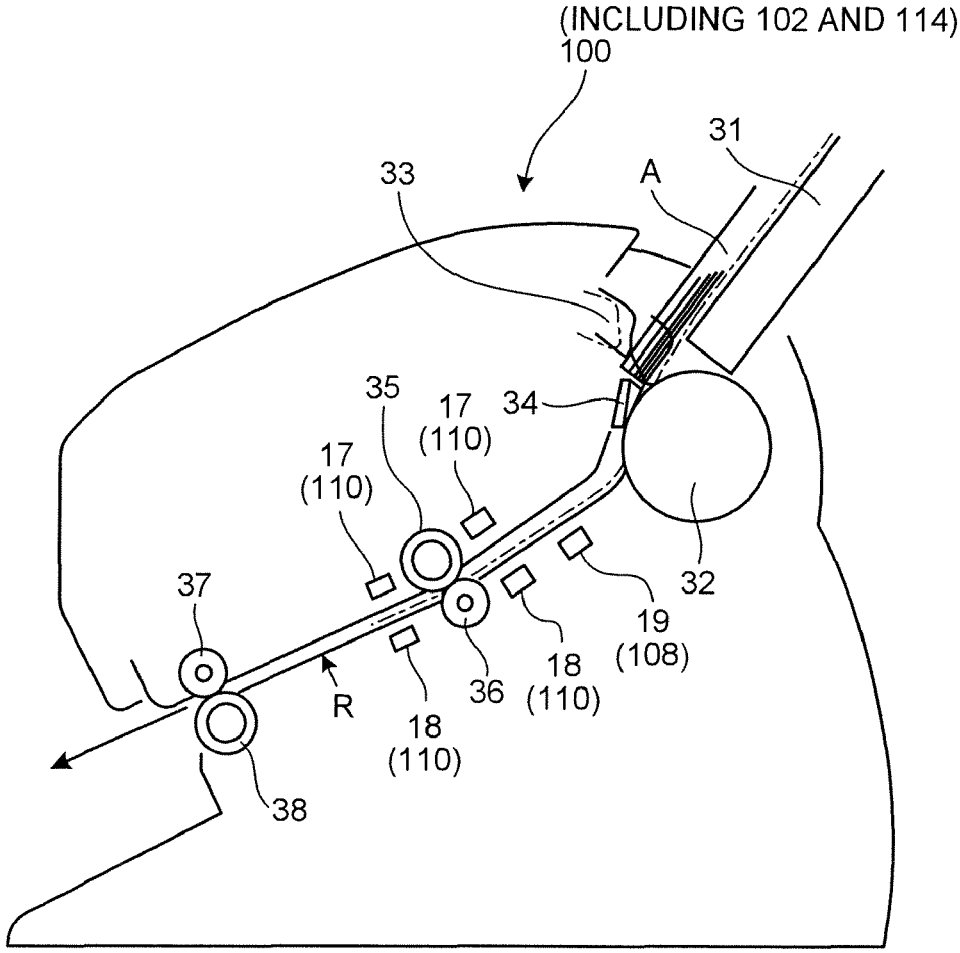
FIG. 6 is a schematic representing a configuration of a scanner being a specific example of the image reading apparatus according to the present embodiment.

FIG. 6 is a schematic representing an overview of a cross section of a scanner as the image reading apparatus 100 (hereinafter, sometimes described as "scanner 100"), and this figure shows an overview of the configuration of the scanner to which the multifeed detecting unit 102 and the image reading unit 114 are applied.

As shown in FIG. 6, the scanner 100 includes a paper mounting table (shooter) 31, a pick roller 32, a pick arm 33, a separation pad 34, feed rollers 35 and 36, and ejection rollers 37 and 38. The scanner 100 also includes a transmission-side ultrasonic sensor 17 and a reception-side ultrasonic sensor 18 (which correspond to the US sensor 110) of an ultrasonic detector, which is explained later, included in the multifeed detecting unit 102, and a paper leading-edge detection sensor 19 (which corresponds to the detection sensor 108). In FIG. 6, a dashed two-dotted line indicates a feed path of a paper A, and an arrow R indicates a reading position of the paper A.

Papers A placed on the paper mounting table (shooter) 31 are picked by the pick roller 32 in a state where the papers A are applied with an appropriate pressing force by the pick arm 33. At this time, the papers A are sequentially separated from their lower side sheet by sheet by the pick roller 32 and the separation pad 34. The picked paper A is further fed to the feed rollers 35 and 36 by the pick roller 32, is fed to the reading position R by the feed rollers 35 and 36, is read by the image reading unit 114 at the reading position R, and is ejected by the ejection rollers 37 and 38. During feeding of the paper A along the feed path, a plurality of sheets (usually two sheets) or multiply fed papers A which are not separated into one sheet each even by the separation pad 34 are detected by the transmission-side ultrasonic sensor 17 and the reception-side ultrasonic sensor 18. Therefore, as shown in FIG. 6, the transmission-side ultrasonic sensor 17 and the reception-side ultrasonic sensor 18 are disposed on the upstream side of the reading position R where the paper is read by the image reading unit 114 in the feed path. Particularly, the sensors are disposed on the downstream side or the upstream side of the feed rollers 35 and 36. The paper leading-edge detection sensor 19 is disposed on further upstream side of the position where the transmission-side ultrasonic sensor 17 and the reception-side ultrasonic sensor 18 are disposed in the feed path.

Figure 7:
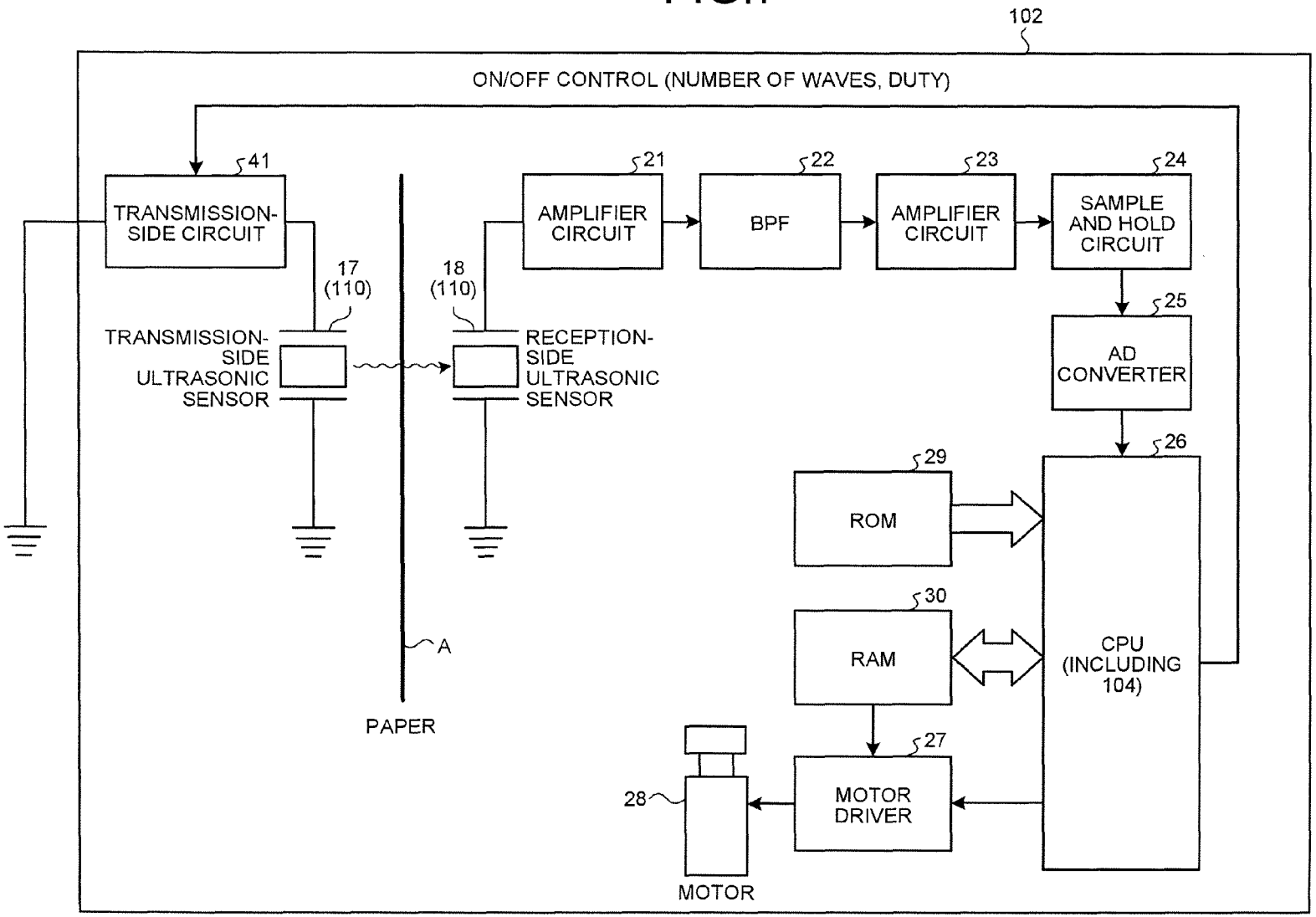
FIG. 7 is a diagram representing one example of a configuration of a multifeed detecting unit included in the scanner shown in FIG. 6.

FIG. 7 is a diagram representing one example of a specific configuration of the multifeed detecting unit 102. In FIG. 7, the ultrasonic detector corresponding to the multifeed detecting unit 102 detects feeding of a plurality of papers A using ultrasonic waves. The ultrasonic detector includes the transmission-side ultrasonic sensor 17, a drive circuit thereof (transmission-side circuit, hereinafter the same) 41, and the reception-side ultrasonic sensor 18.

The transmission-side ultrasonic sensor 17 emits an ultrasonic wave. The drive circuit 41 supplies a drive signal for driving the transmission-side ultrasonic sensor 17 thereto. The drive circuit 41 is configured with a circuit (which can ON/OFF control) that oscillates at a frequency near a resonant frequency of the transmission-side ultrasonic sensor 17. The reception-side ultrasonic sensor 18 is disposed so as to face the transmission-side ultrasonic sensor 17 across a paper feed path, and receives the ultrasonic wave.

The ultrasonic detector further includes an amplifier circuit 21 (at a first stage), a BPF (Band Pass Filter) 22, an amplifier circuit 23 (at a second stage), a sample and hold (S&H) circuit 24, an AD (Analog to Digital) converter 25, CPU 26 (including the control unit 104), a motor driver 27, a motor 28, ROM (Read Only Memory) 29, and RAM (Random Access Memory) 30. These components constitute a reception-side circuit. More specifically, the reception-side ultrasonic sensor 18 outputs an electrical signal according to the ultrasonic wave received from the transmission-side ultrasonic sensor 17, the amplifier circuit 21 amplifies the electrical signal, the BPF removes noise therefrom, and, thereafter, the amplifier circuit 23 further amplifies the signal after the noise is removed. Then, after the sample and hold circuit 24 samples and holds (SH) a peak value of the signal, the AD converter 25 converts the peak value (analog signal) into a digital value (digital signal). The AD converter 25 inputs the digital signal (input signal) to the CPU 26, where it is analyzed. For example, when a multifeed is detected ("Occurrence of MF"), the CPU 26 (which is specifically the multifeed determining unit 104*d*) transmits the drive signal to the motor driver 27, and causes the motor 28 to drive so as to stop feeding of (a plurality of) papers A.

The ultrasonic detector includes the transmission-side circuit (drive circuit) 41. The transmission-side circuit 41 is configured from a drive IC, a resistance/frequency-controlled oscillator (OSC), and a variable resistor. The drive IC is a drive circuit for supplying a drive signal to drive the transmission-side ultrasonic sensor 17 thereto. This causes the transmission-side ultrasonic sensor 17 to emit an ultrasonic wave. The reception-side ultrasonic sensor 18 receives the ultrasonic wave, and outputs a detection signal according to the intensity of the received ultrasonic wave. For example, when the paper A is not present between the transmission-side ultrasonic sensor 17 and the reception-side ultrasonic sensor 18, the reception-side ultrasonic sensor 18 detects a signal with a certain level (ordinary level), and detects a signal with a level (normal level) less than the ordinary level but more than an initialized threshold when a sheet of paper A is present. When two sheets (or more) of paper A are present, the reception-side ultrasonic sensor 18 detects a signal with a level (abnormal level) less than the ordinary level and the threshold. For example, before feeding of the paper A, the drive IC is controlled so that the reception-side ultrasonic sensor 18 detects the signal with the ordinary level (in actual cases, the signal with a level equal to or more than the ordinary level). More specifically, the drive IC is controlled so that the drive frequency of the drive signal coincides with the resonant frequency of the transmission-side ultrasonic sensor 17 based on the ultrasonic wave received by the reception-side ultrasonic sensor 18 without using the variable resistor.

3. Process of Present Embodiment

Figure 8:
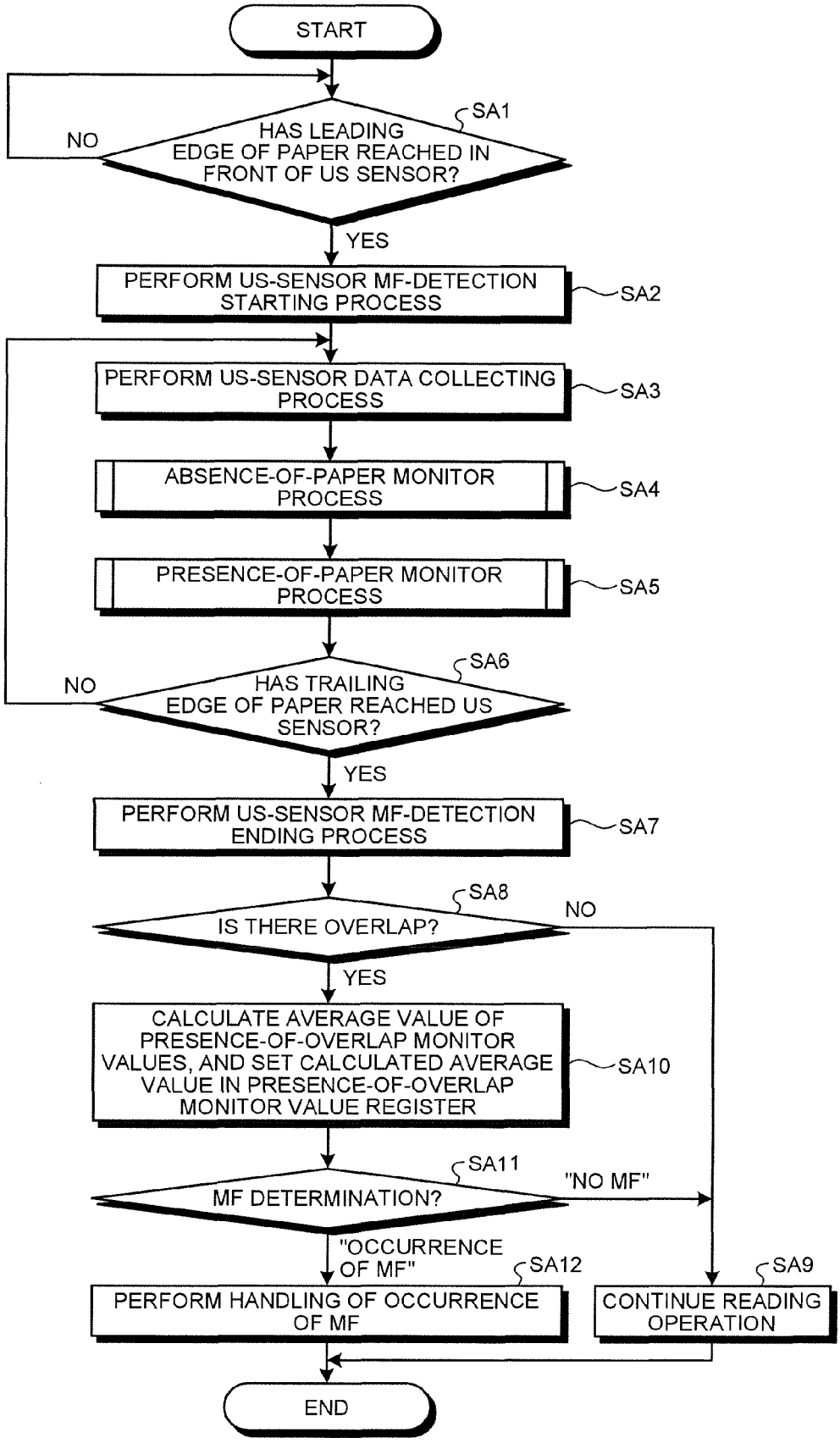
FIG. 8 is a flowchart representing one example of a US-sensor MF detection process according to the present embodiment.

Here, one example of a US-sensor MF detection process or the like executed in the image reading apparatus 100 configured in the above manner will be explained with reference to FIG. 8 to FIG. 11. FIG. 8 is a flowchart representing one example of the US-sensor MF detection process according to the present embodiment.

First, when a leading edge of a fed paper has reached a position which is a predetermined length (e.g., a length of 80% of the distance between the detection sensor 108 and the US sensor 110) in front of the US sensor 110 (Yes at Step SA1), the control unit 104 resets the following registers and flags in the holding unit 106: the absence-of-paper monitor value register, the absence-of-overlap monitor value register, the absence-of-overlap fluctuation-range register, the presence-of-overlap monitor value register, the leading-edge arrival flag, and the slice change flag, and initializes the MF determination slice value obtained in this process to the existing MF determination slice value (e.g., an existing MF determination slice value by taking the cardboard into consideration) (Step SA2: US-sensor MF-detection starting process). It should be noted that the control unit 104 may perform the resetting and initialization when the leading edge of the paper has reached a position which is a predetermined length (e.g., a length of 20% of the distance between the detection sensor 108 and the US sensor 110) forward from the detection sensor 108.

Next, the receiving unit 104*a* synchronizes pulses of a feeding motor and receives a current value (transmittance) of a US-sensor output from the US sensor 110 (Step SA3). The receiving unit 104*a* may also perform a noise-component removal process, explained later, at SA3.

Next, the absence-of-paper monitoring unit 104*b* performs the following absence-of-paper monitor process (Step SA4).

Figure 9:
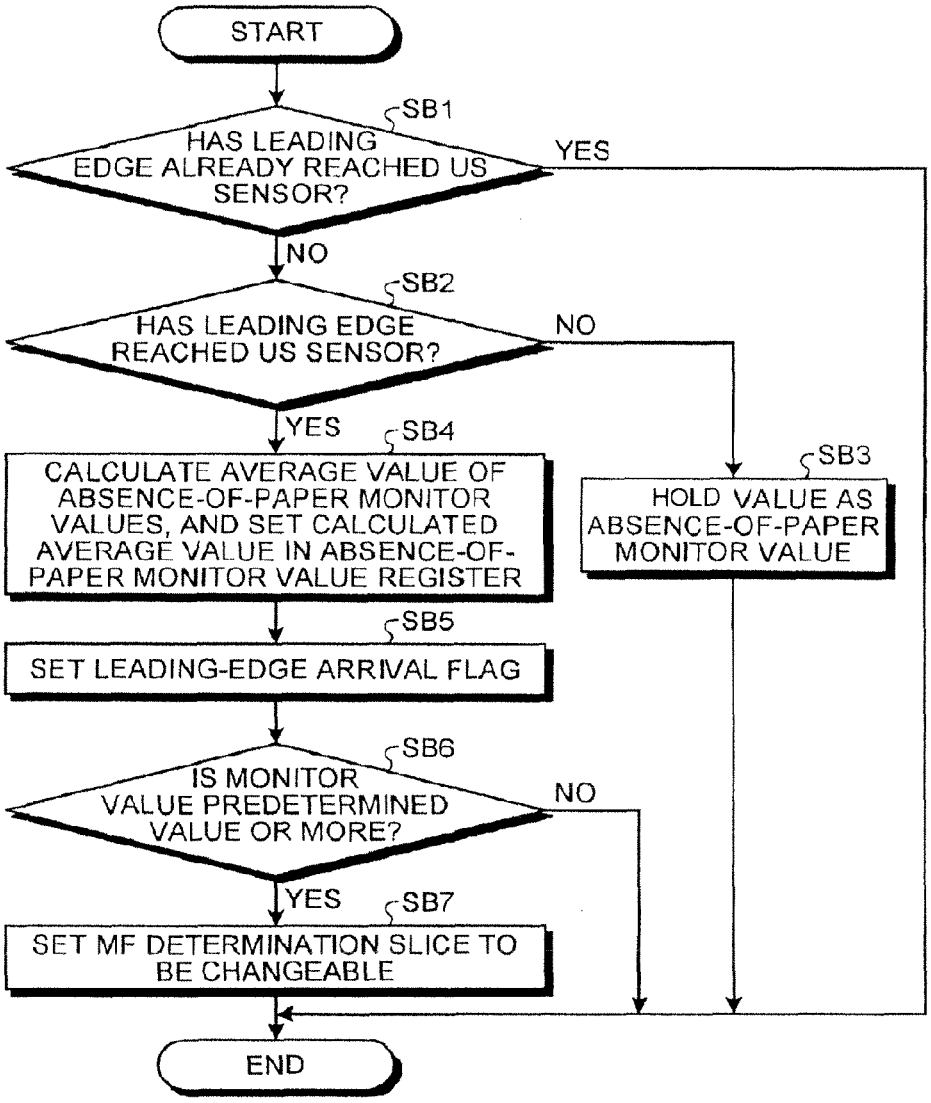
FIG. 9 is a flowchart representing one example of a absence-of-paper monitor process according to the present embodiment.

Here, one example of the absence-of-paper monitor process will be explained with reference to FIG. 9. FIG. 9 is a flowchart representing one example of the absence-of-paper monitor process according to the present embodiment.

First, the absence-of-paper monitoring unit 104*b* checks whether the leading edge of the fed paper has already reached the US sensor 110 using the value held in the leading-edge arrival flag.

Next, when verifying that the leading edge of the fed paper has not reached it yet (No at Step SB1), the absence-of-paper monitoring unit 104*b* checks whether the leading edge of the paper has reached the US sensor 110 at the present moment using the number of motor pulses counted since detection of the leading edge of the paper by the detection sensor 108, or the like. It may also be checked using the current value of the output received at Step SA3.

Next, when verifying that the leading edge of the paper has not reached it yet (No at Step SB2), the absence-of-paper monitoring unit 104*b* holds the current value of the output received at Step SA3 as "absence-of-paper monitor value" (which is, specifically, held in the holding unit 106 based on time series) (Step SB3).

When verifying that the leading edge of the paper has reached (Yes at Step SB2), the absence-of-paper monitoring unit 104*b* calculates an average value of the US-sensor outputs as "absence-of-paper monitor values" held in the holding unit 106, and sets the calculated average value in the absence-of-paper monitor value register (Step SB4).

Next, the absence-of-paper monitoring unit 104*b* sets the leading-edge arrival flag (Step SB5).

Next, the absence-of-paper monitoring unit 104*b* checks whether the average value set in the absence-of-paper monitor value register at Step SB4 is equal to or more than a predetermined value (e.g., 95% of a theoretical maximum value).

Next, when verifying that the average value is equal to or more than the predetermined value (Yes at Step SB6), the absence-of-paper monitoring unit 104*b* recognizes that there is no abnormality in the US-sensor output, and sets the slice change flag in order to enable to change the MF determination slice value in this process (Step SB7).

The explanation on the absence-of-paper monitor process is ended herein.

Referring back to FIG. 8, the presence-of-paper monitoring unit 104*c* performs the following presence-of-paper monitor process (Step SA5).

Figure 10:
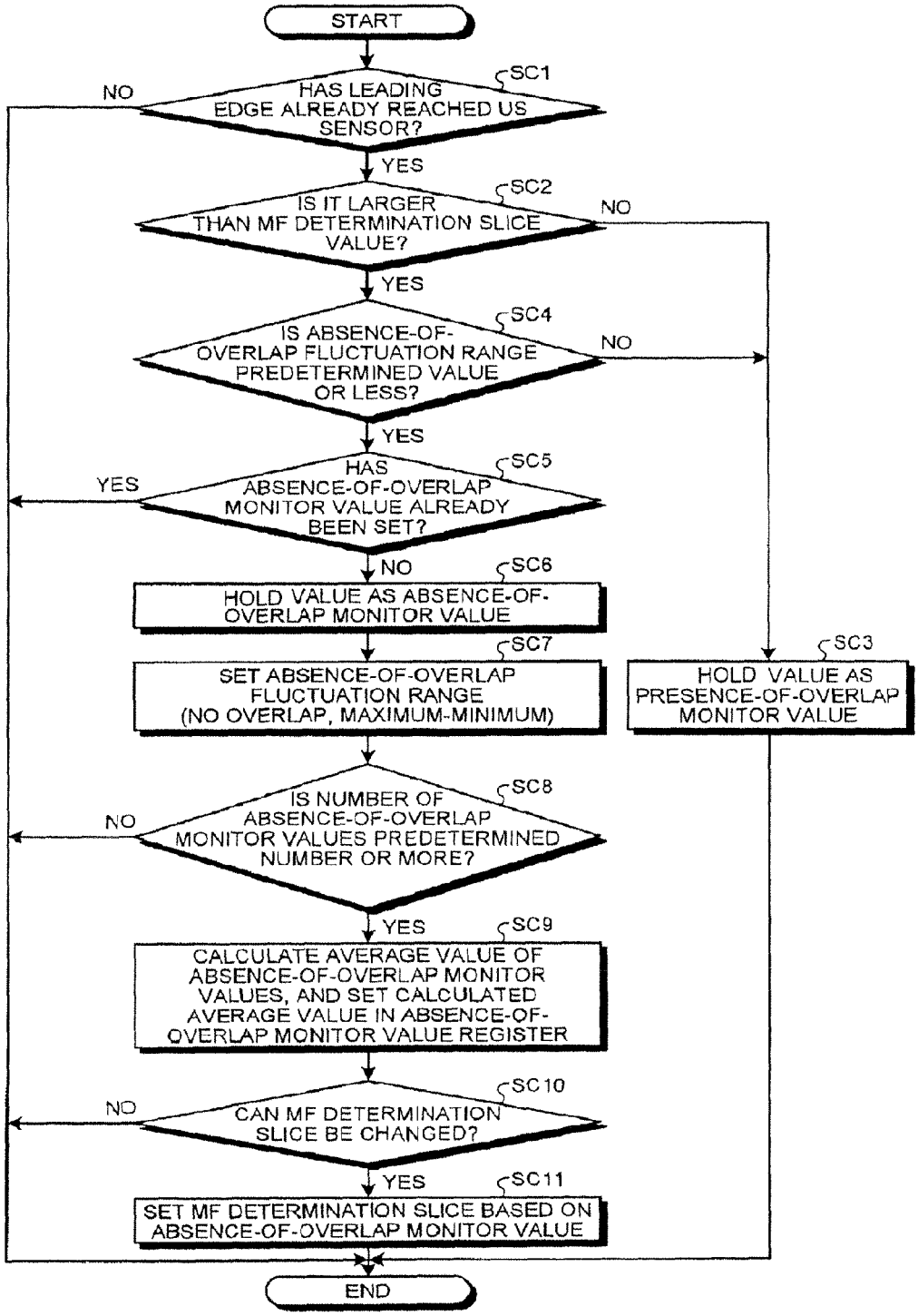
FIG. 10 is a flowchart representing one example of a presence-of-paper monitor process according to the present embodiment.

Here, one example of the presence-of-paper monitor process will be explained with reference to FIG. 10. FIG. 10 is a flowchart representing one example of the presence-of-paper monitor process according to the present embodiment.

First, the presence-of-paper monitoring unit 104*c* checks whether the leading edge of the fed paper has already reached the US sensor 110 using the value held in the leading-edge arrival flag.

Next, when verifying that the leading edge of the paper has already reached the US sensor 110 (Yes at Step SC1), the presence-of-paper monitoring unit 104*c* checks whether the current value of the output received at Step SA3 is larger than the MF determination slice value.

Next, when verifying that the current value of the output is not larger than the MF determination slice value (No at Step SC2), the presence-of-paper monitoring unit 104*c* holds the current value of the output received at Step SA3 as "presence-of-overlap monitor value" (which is, specifically, held in the holding unit 106 based on time series) (Step SC3).

In addition, when verifying that the current value of the output is larger than the MF determination slice value (Yes at Step SC2), the presence-of-paper monitoring unit 104*c* checks whether the value held in the absence-of-overlap fluctuation-range register is equal to or less than a predetermined value (e.g., 15% of the maximum value of the US-sensor outputs received when there is the paper (after the leading edge of the paper reaches the US sensor 110)).

Next, when verifying that the value is not equal to or less than the predetermined value (No at Step SC4), the presence-of-paper monitoring unit 104*c* holds the current value of the output received at Step SA3 as "presence-of-overlap monitor value" (which is, specifically, held in the holding unit 106 based on time series) (Step SC3).

In addition, when verifying that the value is equal to or less than the predetermined value (Yes at Step SC4), the presence-of-paper monitoring unit 104*c* checks whether the average value has already been set in the absence-of-overlap monitor value register.

Next, when verifying that the average value has not been set (No at Step SC5), the presence-of-paper monitoring unit 104*c* holds the current value of the output received at Step SA3 as "absence-of-overlap monitor value" (which is, specifically, held in the holding unit 106 based on time series) (Step SC6).

Next, the presence-of-paper monitoring unit 104*c* sets the fluctuation range (a difference between the maximum value and the minimum value) of the US-sensor outputs as "absence-of-overlap monitor values" held in the holding unit 106, in the absence-of-overlap fluctuation-range register (Step SC7).

Next, the presence-of-paper monitoring unit 104*c* checks whether the number of US-sensor outputs as "absence-of-overlap monitor values" held in the holding unit 106 is equal to or more than a predetermined number (e.g., 50).

Next, when verifying that the number of US-sensor outputs is equal to or more than the predetermined number (Yes at Step SC8), the presence-of-paper monitoring unit 104*c* calculates an average value of the US-sensor outputs as "absence-of-overlap monitor values" held in the holding unit 106, and sets the calculated average value in the absence-of-overlap monitor value register (Step SC9).

Next, the presence-of-paper monitoring unit 104*c* checks whether the MF determination slice value can be changed using the value held in the slice change flag.

When verifying that the MF determination slice value can be changed (Yes at Step SC10), the presence-of-paper monitoring unit 104*c* changes (updates) the MF determination slice value to an optimal value for the thickness of the paper based on the average value set in the absence-of-overlap monitor value register at Step SC9 (Step SC11). Here, a difference value between the average value of the absence-of-overlap monitor value register and the average value of the absence-of-paper monitor value register corresponds to the thickness of the paper. Therefore, an MF slice value "Vslice" may be changed to, for example, a value "Vbase+(Va−Vbase)/2" obtained by adding an output value "Vbase" when there is no oscillation to an intermediate value "(Va−Vbase)/2" of a difference between the previously determined output value "Vbase" when the transmission-side sensor does not oscillate in the absence of a paper (a minimum output value (offset output value)) and an average value "Va" of the absence-of-overlap monitor value register (a maximum output value during feeding of the paper). Moreover, the MF determination slice value may be changed to, for example, a value which is smaller (lower) than the average value of the absence-of-overlap monitor value register and is larger (higher) than a difference between the average value of the absence-of-overlap monitor value register and the difference value. In addition, a relational expression between each of US-sensor outputs for papers with various thicknesses and an optimal MF determination slice value for the paper may be previously set, and the MF determination slice value may be changed to a value obtained by substituting the average value of the absence-of-overlap monitor value register into the relational expression.

The explanation on the presence-of-paper monitor process is ended herein.

Referring back to FIG. 8, when a trailing edge of the fed paper has not reached the US sensor 110 (No at Step SA6), the control unit 104 causes the processing units to perform the processes at Step SA3 to Step SA5.

Next, the multifeed determining unit 104*d*, when the trailing edge of the fed paper has reached the US sensor 110 (Yes at Step SA6), checks whether the US-sensor outputs as "presence-of-overlap monitor values" are held in the holding unit 106 (Step SA7: US-sensor MF detection ending process).

Next, when verifying that the US-sensor outputs are not held (No at Step SA8), the multifeed determining unit 104*d* determines this case as "No MF", and causes the feeding of the paper not to stop and the image reading unit 114 to continue the reading (Step SA9).

In addition, when verifying that the US-sensor outputs are held (Yes at Step SA8), the multifeed determining unit 104*d* calculates an average value of the US-sensor outputs as "presence-of-overlap monitor values" held in the holding unit 106, and sets the calculated average value in the presence-of-overlap monitor value register (Step SA10).

Next, the multifeed determining unit 104*d* compares the average value set in the presence-of-overlap monitor value register at Step SA10 and the MF determination slice value (when the MF determination slice value is changed at Step SC11, the changed MF determination slice value is used, while when it is not changed, the initialized existing MF determination slice value is used).

Next, when the set average value is larger than the MF determination slice value (Step SA11: "No MF"), the multifeed determining unit 104*d* determines this case as "No MF", and causes the feeding of the paper not to stop and the image reading unit 114 to continue the reading (Step SA9).

In addition, when the set average value is equal to or less than the MF determination slice value (Step SA11: "Occurrence of MF"), the multifeed determining unit 104*d* determines this case as "Occurrence of MF", and performs handling of occurrence of MF such that the feeding of the paper is caused to stop and the like (Step SA12).

The explanation on the US-sensor MF detection process is ended herein.

Here, when a difference between a current value of the monitored US-sensor output and a value of the US-sensor output monitored right before the monitoring of the current value is equal to or more than a predetermined value (e.g., 10% of the previous value) at the time of monitoring the US-sensor output (specifically, upon execution at Step SA3) and when the value of the US-sensor output monitored right after the monitoring of the current value is returned to the side of (near to) the value right before the monitoring than the current value, the current value may be replaced with the average value of the value right before the monitoring and the value right after the monitoring (noise-component removal process).

Figure 11:
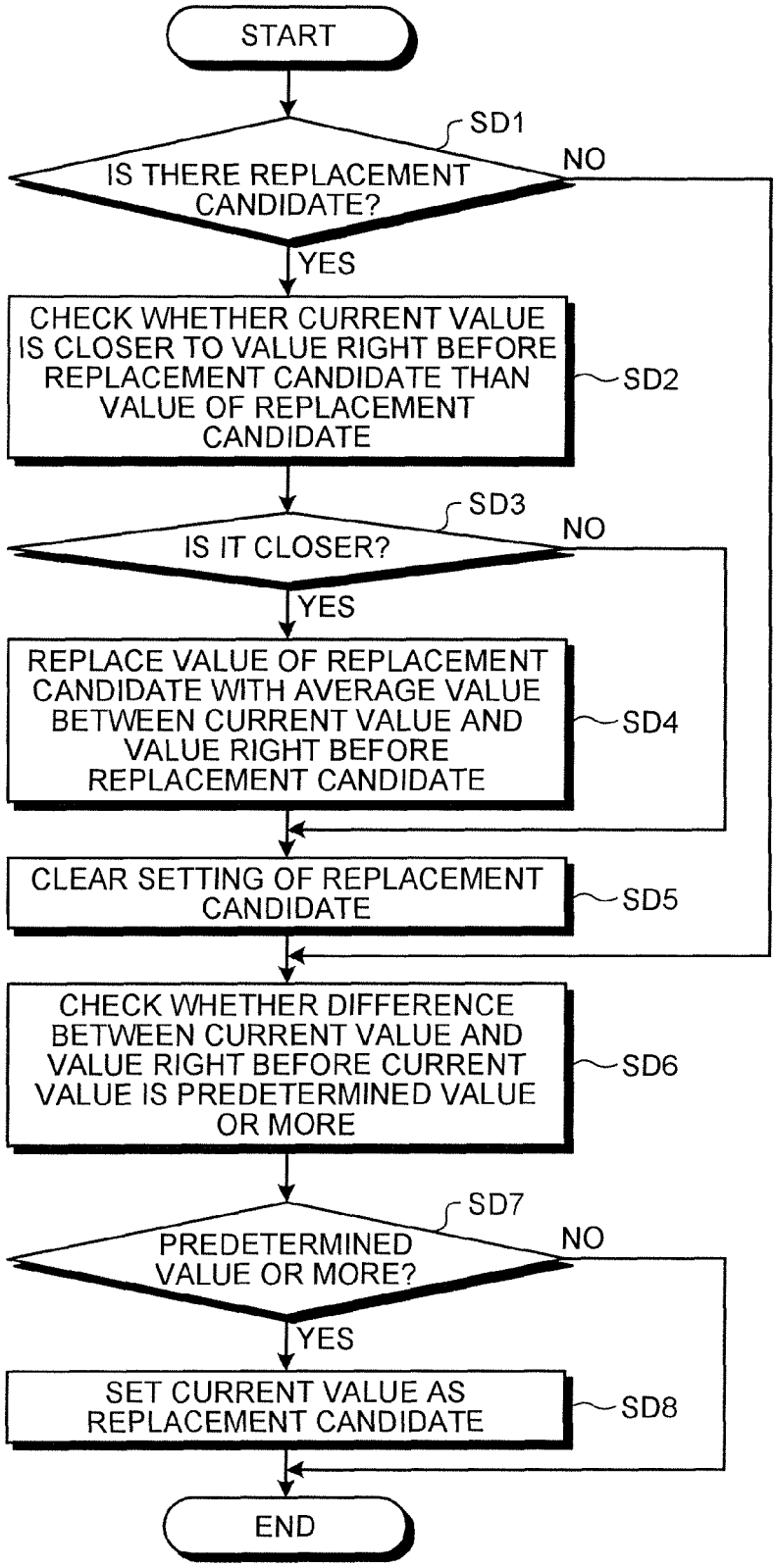
FIG. 11 is a flowchart representing one example of a noise-component removal process according to the present embodiment.

Here, one example of the noise-component removal process will be explained with reference to FIG. 11. FIG. 11 is a flowchart representing one example of the noise-component removal process according to the present embodiment.

First, the receiving unit 104*a*, when verifying that there is a US-sensor output set as a replacement candidate (remark value) in the holding unit 106 (Yes at Step SD1), checks whether the current value of the received US-sensor output is closer (returned) to the value of the US-sensor output right before the replacement candidate than the value of the US-sensor output as the replacement candidate (Step SD2).

Next, when verifying that the current value is closer to the value (Yes at Step SD3), the receiving unit 104*a* regards the value of the US-sensor output as the replacement candidate held in the holding unit 106, as a noise component, and replaces the value with an average value between the current value and the value of the US-sensor output right before the replacement candidate (Step SD4).

Next, the receiving unit 104*a* clears the setting of the replacement candidate (Step SD5).

Next, the receiving unit 104*a* checks whether a difference between the current value of the US-sensor output received at Step SA3 and the value of the US-sensor output held in the holding unit 106 (indicating a value after the replacement when the value is replaced at Step SD4) which is the value right before the current value is equal to or more than a predetermined value (e.g., 10% of the previous value) (Step SD6).

Next, when verifying that the difference is the predetermined value or more (Yes at Step SD7), the receiving unit 104*a* sets the current value as the replacement candidate (Step SD8).

The explanation on the noise-component removal process is ended herein.

4. Summary of Present Embodiment and Other Embodiments

As mentioned above, according to the present embodiment, each value (transmittance) of the US-sensor outputs "in the absence of a paper", "in the absence of an overlap", and "in the presence of an overlap" is monitored, an optimal MF determination slice value for the thickness of the paper is set based on the monitored values "in the absence of a paper" and "in the absence of an overlap", and MF determination is performed using the set MF determination slice value and the value "in the presence of an overlap". Specifically, the output received from the US sensor 110 is held as any one of outputs "in the absence of a paper", "in the absence of an overlap", and "in the presence of an overlap". The previously set MF determination slice value is changed (updated) to an optimal value for the thickness of the paper based on the output held as the output "in the absence of a paper" and the output held as the output "in the absence of an overlap". When there is an output held as the output "in the presence of an overlap", the output is compared with the changed MF determination slice value (optimized MF determination slice value) to perform MF determination. This allows MF detection accuracy for papers of all thicknesses to be improved.

According to the present embodiment, when the monitored output of the US sensor has largely changed as compared with the outputs before and after the monitoring, the monitored output is replaced with an average value of the outputs before and after the monitoring. Specifically, when a difference between the current value of the output received this time and the output received last time is the predetermined value or more, the current value of the output received this time is set as a replacement candidate. If the output received last time has been set as the replacement candidate and when the current value of the output received this time is closer to the output received before the last than the output received last time, then the output received last time as the replacement candidate is replaced with an average value between the current value of the output received this time and the output received before the last. As a result, the temporary variation of the US-sensor outputs is ignored (particularly, an unstable element (noise component) of US-sensor outputs before and after the MF determination slices is removed), so that an overlap portion can be accurately and stably detected.

Moreover, the present invention may be implemented in various different embodiments in the scope of technical idea described in the appended claims other than the embodiment. For example, of the processes explained in the embodiment, all or part of the processes explained as automatically performed ones can be manually performed, or all or part of the processes explained as manually performed ones can be also automatically performed using known methods. A specific configuration of distribution or integration of the apparatuses is not limited to the illustrated one. The apparatuses can be configured by functionally or physically distributing or integrating all or part of the apparatuses in arbitrary units according to various types of additions or the like or according to functional loads. In addition, the process procedures, the control procedures, the specific names, and the screen examples shown in the present specification and the drawings can be arbitrarily modified unless otherwise specified.

The constituent elements of the image reading apparatus 100 shown in the drawings are functionally conceptual, and need not be physically configured as illustrated. For example, for the process functions provided in the image reading apparatus 100, especially for the process functions performed in the control unit 104, all or part thereof may be implemented by a CPU and programs interpreted and executed in the CPU, and may be implemented as hardware by wired logic. The programs are recorded in a recording medium, explained later, and they are mechanically loaded into the image reading apparatus 100 as required. More specifically, computer programs to perform various processes are recorded in ROM or an HD (Hard Disk). The computer programs are executed by being loaded into RAM, and form the control unit in cooperation with the CPU.

The image reading apparatus according to the present invention can be achieved by installing software (including the programs, the data, and the like) to implement the multifeed determining method according to the present invention. The multifeed determining program according to the present invention may be stored in a computer-readable recording medium, or can be configured as a program product. The "recording medium" mentioned here includes any "portable physical medium" such as a flexible disk, a magneto-optical disc, ROM, EPROM (Erasable Programmable Read Only Memory), EEPROM (Electronically Erasable and Programmable Read Only Memory), CD-ROM (Compact Disk Read Only Memory), MO (Magneto-Optical disk), and a DVD (Digital Versatile Disk) or includes a "communication medium" that temporarily holds a program, such as a communication line and a carrier used to transmit the program through a network such as LAN (Local Area Network), WAN (Wide Area Network), and the Internet. The "program" mentioned here is a data processing method described in an arbitrary language and description method, and thus any form such as a source code and a binary code is acceptable. It should be noted that the "program" is not necessarily limited to a program configured as a single unit, and, therefore, includes those distributedly configured as a plurality of modules and libraries and those in which the function of the program is achieved in cooperation with separate programs represented as OS. Regarding a specific configuration and a reading procedure to read a recording medium by the apparatuses shown in the embodiments, or an installation procedure after the reading, or the like, known configuration and procedures can be used.

According to the present invention, each of multi-valued output values (transmittances) of the US-sensor in the absence of a paper, in the absence of an overlap, and in the presence of an overlap is monitored, an optimal MF determination slice value for the thickness of the paper is set based on the monitored values in the absence of a paper and in the absence of an overlap, and MF determination is performed using the set MF determination slice value and the value in the presence of an overlap. Specifically, (1) the output received from the US sensor is held as any one of an output when there is no paper, an output when there is no overlap of papers, and an output when there is an overlap of papers, (2) the previously set MF determination slice value is changed to an optimal value for the thickness of the paper based on the output held as the output when there is no paper and the output held as the output when there is no overlap of papers, and (3) when there is an output held as the output when there is an overlap of papers, the output is compared with the optimal MF determination slice value for the thickness of the paper after it is changed, to perform MF determination. Thus, there is such an effect that this allows MF detection accuracy to be improved.

According to the present invention, when the monitored multi-valued output value of the US sensor has largely changed as compared with the outputs before and after the monitoring, the monitored output is replaced with an average value of the outputs before and after the monitoring. Specifically, (1) when a difference between the output received this time and the output received last time is the predetermined value or more, the output received this time is set as a replacement candidate, (2) if the output received last time has been set as the replacement candidate and when the output received this time is closer to the output received before the last than the output received last time, then the output received last time as the replacement candidate is replaced with an average value between the output received this time and the output received before the last. As for the thin paper in particular, a temporary variation can be seen in outputs of the US sensor. However, in the conventional technology, because a multi-valued output value of the US sensor is used as it is, an overlap portion cannot sometimes be detected precisely. In the present invention, therefore, if a monitored multi-valued output value of the US sensor largely varies as compared with values before and after the monitoring, the monitored value is replaced with an average value of the values before and after the monitoring. Thus, there is such an effect that the temporary variation of the US-sensor output is ignored (particularly, an unstable element (noise component) of US-sensor outputs before and after the MF determination slice is removed), so that an overlap portion can be accurately and stably detected.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image reading apparatus comprising:

an ultrasonic sensor; and a control unit including a receiving unit that receives an output of the ultrasonic sensor, a holding unit that holds the output received by the receiving unit as any one of an output when there is no paper, an output when there is no overlap of papers, and an output when there is an overlap of papers, a changing unit that changes a previously set threshold of multifeed determination to an optimal value for a thickness of the paper based on the output held as the output when there is no paper and the output held as the output when there is no overlap of papers by the holding unit, and a determining unit, when there is an output held as the output when there is an overlap of papers by the holding unit, compares the output and a threshold after it is changed by the changing unit, to perform multifeed determination, wherein the receiving unit, when a difference between an output received this time and an output received last time is equal to or greater than a predetermined value, sets the output received this time as a replacement candidate, and if the output received last time has been set as the replacement candidate and when the output received this time is closer to an output received before the last time than the output received last time, replaces the output received last time as the replacement candidate with an average value between the output received this time and the output received before the last time.

2. A multifeed determining method implemented by a control unit of an image reading apparatus that includes an ultrasonic sensor and the control unit, the multifeed determining method comprising:

a receiving step of receiving an output of the ultrasonic sensor;

a holding step of holding the output received at the receiving step as any one of an output when there is no paper, an output when there is no overlap of papers, and an output when there is an overlap of papers;

a changing step of changing a previously set threshold of multifeed determination to an optimal value for a thickness of the paper based on the output held as the output when there is no paper and the output held as the output when there is no overlap of papers at the holding step; and a determining step of, when there is an output held as the output when there is an overlap of papers at the holding step, comparing the output and a threshold after it is changed at the changing step, to perform multifeed determination, wherein the receiving step, when a difference between an output received this time and an output received last time is equal to or greater than a predetermined value, sets the output received this time as a replacement candidate, and if the output received last time has been set as the replacement candidate and when the output received this time is closer to an output received before the last time than the output received last time, replaces the output received last time as the replacement candidate with an average value between the output received this time and the output received before the last time.

3. A non-transitory tangible computer-readable medium having a multifeed determining program for a processor of an image reading apparatus that includes an ultrasonic sensor, the program, when executed, configuring the processor to perform a multifeed determining method comprising:

a receiving step of receiving an output of the ultrasonic sensor;

a holding step of holding the output received at the receiving step as any one of an output when there is no paper, an output when there is no overlap of papers, and an output when there is an overlap of papers;

a changing step of changing a previously set threshold of multifeed determination to an optimal value for a thickness of the paper based on the output held as the output when there is no paper and the output held as the output when there is no overlap of papers at the holding step; and a determining step of, when there is an output held as the output when there is an overlap of papers at the holding step, comparing the output and a threshold after it is changed at the changing step, to perform multifeed determination, wherein the receiving step, when a difference between an output received this time and an output received last time is equal to or greater than a predetermined value, sets the output received this time as a replacement candidate, and if the output received last time has been set as the replacement candidate and when the output received this time is closer to an output received before the last time than the output received last time, replaces the output received last time as the replacement candidate with an average value between the output received this time and the output received before the last time.

* * * * *